United States Patent [19]

Contreras

[11] 4,015,630

[45] Apr. 5, 1977

[54] REGULATOR FIRST STAGE FOR UNDERWATER DIVING

[75] Inventor: Boris L. Contreras, Huntington Park, Calif.

[73] Assignee: Pittman Products, Inc., Huntington Park, Calif.

[22] Filed: Oct. 23, 1975

[21] Appl. No.: 625,065

[52] U.S. Cl. ..... 137/505.25; 137/DIG. 9; 128/142.2

[51] Int. Cl.[2] ..... F16K 31/12

[58] Field of Search ..... 137/505.25, DIG. 9, 137/613; 128/142, 142.2, 142.3; 9/313, 314

[56] References Cited

UNITED STATES PATENTS

| | | | |
|---|---|---|---|
| 2,483,116 | 9/1949 | Yarbrough | 128/142 |
| 3,037,502 | 6/1962 | Gibbens | 128/142 X |
| 3,147,499 | 9/1964 | Nelson | 9/313 |
| 3,426,790 | 2/1969 | Dey | 137/505.25X |
| 3,436,777 | 4/1969 | Greenwood | 9/313 X |
| 3,698,425 | 10/1972 | Fisher | 137/505.25 |
| 3,727,250 | 4/1973 | Koehn | 128/142.2 X |
| 3,799,189 | 3/1974 | Christianson | 137/505.25 X |

*Primary Examiner*—Harold W. Weakley
*Attorney, Agent, or Firm*—Robert C. Comstock

[57] ABSTRACT

A regulator first stage for underwater diving which provides an added low pressure port for connection to an automatic vest inflator. The added port permits a shorter and more direct connection between the regulator and inflator. It also provides restricted flow to the vest to prevent too rapid inflation and/or over-inflation and provide better control of the vest inflation by the diver.

3 Claims, 2 Drawing Figures

REGULATOR FIRST STAGE FOR UNDERWATER DIVING

BACKGROUND OF THE INVENTION

1. Field of the Invention

The invention relates to a regulator first stage for underwater diving.

2. Description of the Prior Art:

Underwater diving regulators are now frequently used with inflated vests and automatic vest inflators which are connected to the regulator first stage.

At the present time, it is necessary for the hose which connects the vest inflator to the regulator to bend around the neck or back of the diver and connect over the right shoulder of the diver. This requires a fairly long piece of hose which is awkward and which may get in the way of the diver or may possibly become entangled in use.

The vest inflator is presently connected to a low pressure port which has no restriction as to its rate of flow and which may accordingly cause the vest to be inflated too rapidly. Such excessively rapid inflation may cause too rapid ascension of the diver or may have to be compensated by deflating the vest to remove over-inflation.

SUMMARY OF THE INVENTION

The primary object of the invention is to provide a regulator first stage for underwater diving which overcomes the objectionable features of presently existing regulators when used in combination with vest inflators.

In particular, the present invention provides a regulator first stage in which an added low pressure port is provided which is adjacent to the high pressure port of the regulator. This new port makes possible a direct connection between the regulator and vest inflator which is substantially shorter and which does not require the hose to go over the neck or back of the diver.

In providing this new low pressure port, passages are provided through the regulator valve body and through the high pressure seat. These passages are of limited diameter and they accordingly act to restrict the volume and rate of flow to the vest inflator. This prevents excessively rapid inflation of the vest and provides both slower and more precise and uniform control for the diver.

It is accordingly among the objects of the invention to provide a regulator first stage having all of the advantages and benefits set forth above and described in further detail hereinafter in this specification.

The invention also comprises such other objects, advantages and capabilities as will later more fully appear and which are inherently possessed by the invention.

While there is shown in the accompanying drawings a preferred embodiment of the invention, it should be understood that the same is susceptible of modification and change without departing from the spirit of the invention.

DESCRIPTION OF THE PREFERRED EMBODIMENT

Figure 1:
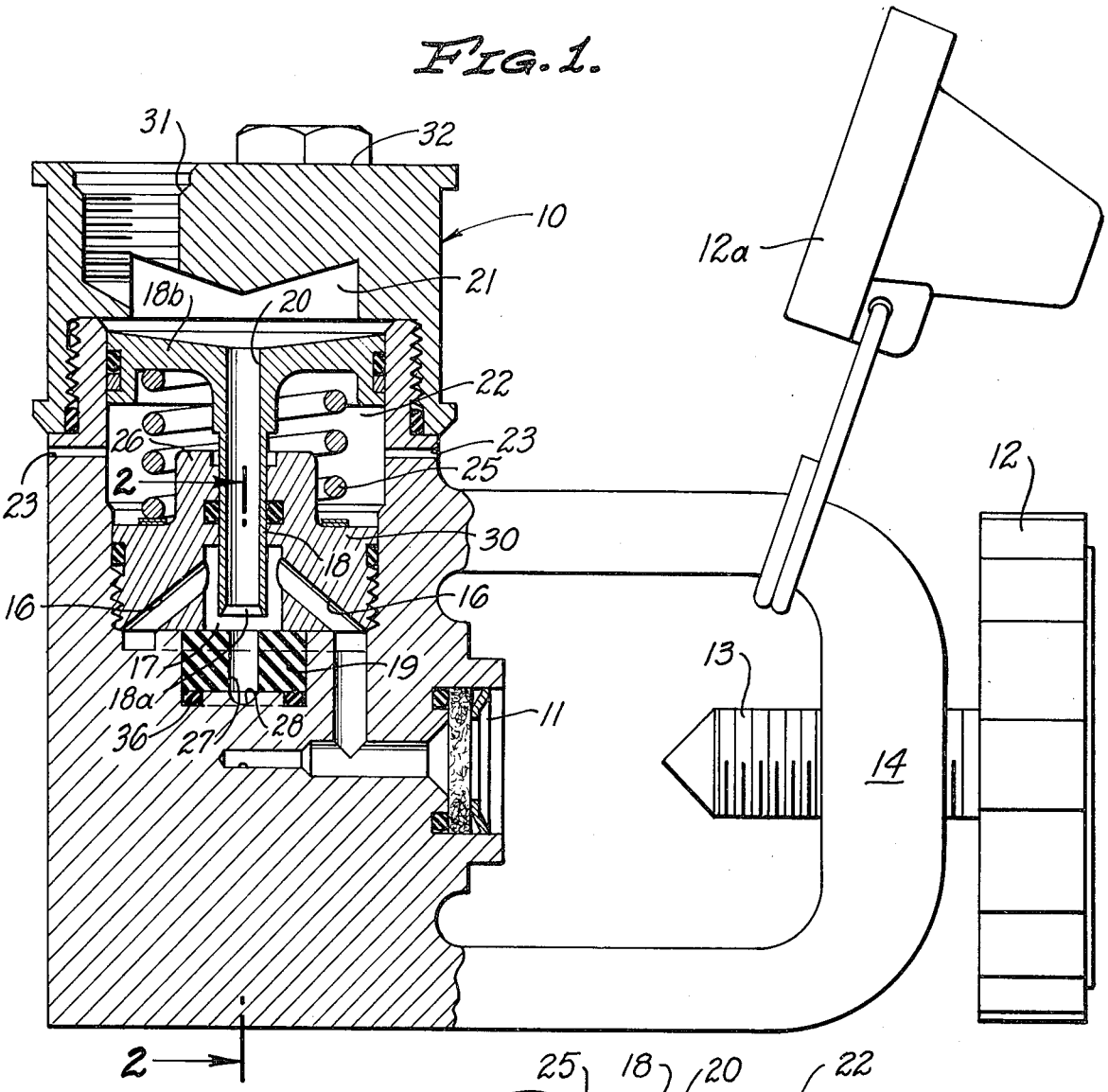
FIG. 1 is a longitudinal sectional view of a regulator first stage embodying the present invention.
Figure 2:
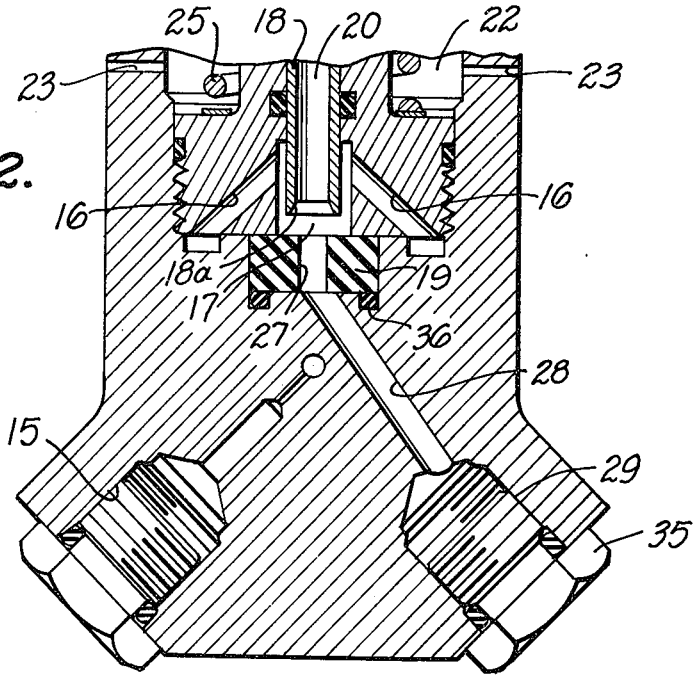
FIG. 2 is a partial transverse sectional view of the same taken on line 2—2 of FIG. 1.

A preferred embodiment which has been selected to illustrate the invention comprises a conventional regulator body 10 having a high pressure inlet 11 which is adapted to be connected to a suitable source of high pressure air or gas, customarily a tank cylinder not shown in the drawings. A knob 12 has a shank 13 which extends transversely through a yoke 14. The knob 12 is used to attach the regulator body 10 to the tank. A protective cap **12*a* is loosely mounted on the yoke 14.**

The high pressure inlet 11 is connected through conventional passages in the body 10 to a high pressure outlet 15 which is offset diagonally on one end of the regulator body 10. The high pressure inlet 11 is also connected to passage means 16 extending diagonally through a stationary gland 30 which is disposed within the body 10. The passage means 16 are connected at their opposite end to a high pressure chamber 17 which is formed within the gland 30.

Extending into the high pressure chamber 17 is the open end **18*a* of a reciprocally movable piston 18. The end 18*a* is adapted to seal against a valve seat 19 when the piston 18 is in closed position, which would be downward position in the drawings. The piston 18 is provided with a longitudinally directed passage 20 which opens into a low pressure chamber 21. The passage 20 connects the high pressure chamber 17 to the low pressure chamber 21 when the end 18*a* of the piston 18 is moved away from the valve seat 19.**

An ambient pressure chamber 22 is disposed between the high pressure chamber 17 and the low pressure chamber 21. One or more openings 23 extends through the wall of the valve body 10 to connect the chamber 22 to ambient pressure.

A coil spring 25 is disposed within the ambient pressure chamber 22. One end of the coil spring 25 fits around an integral enlargement 26 on the gland 30 and bears against the adjacent portion of the gland 30. The other end of the coil spring 25 bears against the enlarged opposite end **18*b* of the piston 18 and normally urges the piston 18 in an upward direction as illustrated in the drawings. The coil spring 25 accordingly normally urges the open end 18*a* of the piston 18 away from the valve seat 19.**

The novel structure of the present invention resides in the provision of an opening 27 which extends through the center of the valve seat 19. The opening 27 is dimensioned so that its periphery is completely surrounded and closed off by the open end **18*a* of the piston 18 when such end 18*a* is in sealing engagement with the valve seat 19. The outer end of the valve seat 19 engages an O-ring 36** which extends around its periphery for additional sealing.

A passage 28 extends diagonally through the regulator body 10 to connect the opposite end of the opening 27 to an additional internally threaded low pressure port 29 which is disposed at the opposite end of the regulator body 10 from the low pressure chamber 21. The low pressure port 29 may be closed by a removably mounted plug 30. Upon removal of the plug 35, the low pressure port 29 may be connected to a short hose (not shown in the drawings), the opposite end of which is connected to a vest inflator.

When the diver inhales, air or gas is drawn outwardly from the low pressure chamber 21 through one of a pair of conventional low pressure ports 31 and 32 in response to demand from the regulator second stage. This reduces the pressure within the low pressure chamber 21. The coil spring 25 will then move the piston 18 toward the reduced pressure, thereby moving its end 18*a* away from the valve seat 19 a short distance to permit air or gas to flow from the high pressure chamber 17 into the exposed end of the passage 20 and through it to the low pressure chamber 21. Upon the increase of pressure in the low pressure chamber 21, such pressure forces the piston 18 back against the pressure of coil spring 25 to closed position.

The passage 27 which extends through the valve seat 29 and/or the passage 28 leading to the additional low pressure port 29 is preferably of smaller cross-sectional diameter than the passage 20 which extends through the piston 18. The rate of flow through the port 29 is accordingly reduced in order to prevent too rapid inflation of the vest.

I claim:

1. A regulator first stage for underwater diving comprising a regulator body, said body having a high pressure inlet connected to a high pressure chamber, a low pressure chamber having at least one low pressure port connected thereto, a piston mounted for reciprocal movement within said regulator, a passage extending longitudinally through said piston and connecting said high pressure chamber to said low pressure chamber, a high pressure port connected to said high pressure chamber and disposed at the end of said regulator body adjacent to said high pressure chamber, a valve seat for engaging the end of said piston to close off said passage, an opening extending through said valve seat in alignment with the passage extending through said piston, an additional low pressure port formed in said regulator body, passage means extending through said regulator body and connecting said additional low pressure port to said opening in said valve seat, whereby said additional low pressure port is connected to said low pressure chamber through said passage in said piston, at least a portion of the flow path between the end of said piston and said additional low pressure port being of smaller cross-sectional diameter than the passage through said piston, whereby the rate of flow to said vest is less than the rate of flow through the conventional low pressure port of said regulator, and means for removably connecting a vest inflator hose to said additional low pressure port.

2. The structure described in claim 1, in which said additional low pressure port is located at the same end of said regulator body as said high pressure port, to provide a more direct hose connection between said regulator and said vest inflator.

3. The structure described in claim 2, in which said high pressure port extends diagonally at one end of said regulator, said additional low pressure port extending diagonally at the same end of said regulator as said high pressure port, at a diagonal opposite to that of said high pressure port, said passage through said regulator body to said additional low pressure port extending diagonally between said valve seat and the inner end of said low pressure port.

* * * * *